US006959625B2

(12) United States Patent
Pettit, Jr.

(10) Patent No.: US 6,959,625 B2
(45) Date of Patent: Nov. 1, 2005

(54) FASTENER INSTALLATION TOOL

(76) Inventor: Jack E. Pettit, Jr., P.O. Box 76, Genoa, NV (US) 89411

( * ) Notice: Subject to any disclaimer, the term of this patent is extended or adjusted under 35 U.S.C. 154(b) by 27 days.

(21) Appl. No.: 10/789,513

(22) Filed: Feb. 27, 2004

(65) Prior Publication Data

US 2004/0177724 A1 Sep. 16, 2004

Related U.S. Application Data

(60) Provisional application No. 60/455,013, filed on Mar. 13, 2003.

(51) Int. Cl.[7] ..... B25B 17/00

(52) U.S. Cl. ..... 81/56; 81/57.14

(58) Field of Search ..... 81/55, 56, 57.14, 81/475

(56) References Cited

U.S. PATENT DOCUMENTS

| | | | | |
|---|---|---|---|---|
| 2,882,773 A | | 4/1959 | Wing | |
| 3,247,741 A | | 4/1966 | Batten | |
| 3,397,601 A | | 8/1968 | Batten | |
| 5,109,735 A | | 5/1992 | Hart | |
| 5,305,666 A | * | 4/1994 | LaTorre | 81/55 |
| 5,553,519 A | | 9/1996 | Pettit, Jr. | |
| 5,699,702 A | | 12/1997 | Myers | |
| 5,778,741 A | * | 7/1998 | Batten | 81/56 |

* cited by examiner

*Primary Examiner*—Debra S Meislin
(74) *Attorney, Agent, or Firm*—Kelly Lowry & Kelley, LLP

(57) ABSTRACT

An improved fastener installation tool is provided of the type having a fixture pin for seated reception into a mating recess at the shank end of a threaded fastener, while a power-driven socket installs a threaded nut onto the fastener shank. The installation tool incorporates a simplified spring-loaded clutch assembly including a dual function spring member for urging the fixture pin axially forwardly relative to the power-driven socket, whereby the fixture pin slidably retracts against the applied spring force as the nut is threaded onto the fastener shank. The spring member additionally urges a cam pin into normal engagement with a lobed cam wheel carried by the fixture pin for normally preventing fixture pin rotation, but wherein the cam pin retracts to accommodate limited fixture pin rotation in response to a torque overload condition thereby protecting the fixture pin against deformation or breakage.

20 Claims, 4 Drawing Sheets

FASTENER INSTALLATION TOOL

This application claims the benefit of U.S. Provisional Application No. 60/455,013, filed Mar. 13, 2003.

BACKGROUND OF THE INVENTION

This invention relates generally to improvements in power tools for use in the installation of threaded fasteners, particularly such as threaded fasteners of the type used in the aerospace and related industries. More specifically, this invention relates to improvements in a fastener installation tool of the general type disclosed in U.S. Pat. No. 5,553,519, including a power-driven socket for installing a threaded nut onto the shank of a threaded fastener, in combination with a fixture pin for normally engaging and retaining the threaded fastener against rotation during power-driven nut installation. The improved fastener installation tool includes a simplified spring-loaded clutch assembly for accommodating limited fixture pin rotation in response to a torque overload condition, thereby protecting the fixture pin against undesired deformation damage or breakage.

A variety of specialized fasteners have been developed and are widely used in the aerospace and related industries, wherein these specialized fasteners have been designed to meet specific design criteria and uses. One example of such specialized threaded fastener comprises a threaded bolt adapted for power-driven installation of a threaded nut onto the bolt shank, without requiring access to the bolt head. That is, such fasteners are designed to fit through a preformed opening in a substrate or other panel-like structure with the bolt head inaccessibly disposed at a blind side thereof. The bolt shank protrudes through the substrate opening with a threaded end exposed for screw-on installation of the threaded nut. The shank end of the bolt is formed to include a small shallow recess of typically hexagonal shape for receiving a mating key used to retain the bolt against rotation as the threaded nut is installed.

Power-driven installation tools are known for use in installing such fasteners. Such fastener installation tools include a power-driven socket for receiving and supporting the threaded nut, and for rotatably driving the threaded nut onto the threaded bolt shank. A generally coaxially positioned fixture pin is also included and carries a key such as a hex key or the like for slide-fit reception into the shallow recess formed in the end of the bolt shank. The fixture pin is normally retained against rotation relative to the power-driven socket, whereby the fixture pin normally retains the threaded bolt against rotation during the nut installation process. Some fastener installation tools of this type further include clutch means for permitting at least some fixture pin rotation in response to a torque overload condition to protect the fixture pin and key against undesired bending or breaking. One example of such power-driven fastener installation tools is shown and described in U.S. Pat. No. 5,553,519, which is incorporated by reference herein.

More particularly, in a typical fastener application using a power-driven installation tool of the above-described type, the key on the fixture pin engages and supports the fastener shank against rotation as the power-driven socket rotatably drives the nut onto the threaded bolt shank. During this step, the fixture pin and key are progressively retracted axially into the tool relative to the socket, in order to remain fully seated within the fastener end recess as the nut is rotatably advanced onto the bolt shank. At least some friction between the bolt and the substrate assists the fixture pin in retaining the fastener against rotation during nut installation. In some installations, however, particularly such as in the case of composite material substrates in aircraft and the like, friction may contribute minimally to bolt retention during nut installation. Accordingly, the fixture pin and key may comprise the primary or sole structure for preventing bolt rotation during nut installation. Torque loads between the power-driven socket and the bolt can sometimes be transmitted directly to the fixture pin and key, resulting in over-torquing and bending or breaking thereof. When this occurs, it is necessary to remove the installation tool from service for appropriate repair or replacement.

U.S. Pat. No. 5,553,519 shows and describes a spring-loaded clutch assembly for safeguarding the fixture pin and key against damage in response to a torque overload condition. However, the clutch assembly comprises a relative complicated structure consisting of multiple assembled components adapted to protect against torque overload damage while still accommodating fixture pin retraction as the power-driven socket is advanced to rotatably install a threaded nut onto the bolt shank.

There exists, therefore, a need for further improvements in and to fastener installation tools of the type having a fixture pin disposed coaxially within a power-driven socket, particularly with respect to providing a simplified spring-loaded clutch assembly for protecting the fixture pin against torque overload damage. The present invention fulfills these needs and provides further related advantages.

SUMMARY OF THE INVENTION

In accordance with the invention, an improved power-driven fastener installation tool for use with a threaded fastener of the type having a shallow recess formed in the shank end thereof for receiving a fixture pin which supports the fastener against rotation during power-drive installation of a threaded nut. The fixture pin is supported on a tool head by an improved and simplified spring-loaded clutch assembly for permitting at least some fixture pin rotation in response to a torque overload condition to protect the fixture pin against breakage or other damage. The clutch assembly further accommodates axial retraction of the fixture pin relative to a power-driven socket on the tool head, as the power-driven socket rotatably installs the threaded nut onto the threaded fastener shank.

The fastener installation tool comprises the elongated fixture pin mounted on the tool head generally coaxially relative to the socket which is associated with power-drive means for rotatably driving the socket at a selected or variable speed. The socket is adapted for receiving and supporting a threaded nut for installation onto the threaded shank of a fastener such as a bolt or the like. The fixture pin is longitudinally or axially slidably movable relative to the socket and includes a forward or distal tip end defining a key of hexagonal shape or the like for slide-fit reception into a matingly shaped shallow recess formed in the end of the fastener shank. The fixture pin and key are normally restrained against rotation and thereby retain the fastener against rotation as the threaded nut is rotatably installed by the power-driven socket onto the threaded fastener shank. As the socket advances the nut onto the fastener shank, the fixture pin axially retracts relative thereto.

The clutch assembly, in accordance with a preferred form of the invention, comprises a lobed cam wheel carried by the fixture pin and defining a plurality of radially outwardly protruding cam teeth or lobes which correspondingly define a plurality of radially outwardly open detents or cam seats. A dual or multi-function spring member is mounted on the tool head and includes a primary spring element applying an axial first spring force to the fixture pin urging the fixture pin axially forwardly so that the key thereon protrudes from the socket for facilitated slide-fit reception into the end recess formed in the fastener shank. In addition, the spring member applies a secondary spring element applying a radial second spring force urging a cam element or pin into normal seated reception into one of the cam wheel detents for restraining and retaining the fixture pin against rotation. The magnitude of this radial second spring force may be adjusted.

The dual function spring member comprises, in the preferred form, the primary spring element in the form of a leaf spring mounted onto the tool head and defining a movable leaf engaged with an axially rearward or proximal end of the fixture pin, or with the cam wheel carried thereby. As the fixture pin slidably retracts relative to the power-driven socket and tool head upon installation of a nut onto the fastener shank, the movable spring leaf retracts while remaining in spring-biased engagement with the fixture pin or cam wheel carried thereby. The secondary spring element is carried at one side of the movable spring leaf and includes the cam pin at a free or distal end thereof spring-biased radially inwardly for seated engagement into an aligned one of the cam wheel seats or detents. A comparatively more rigid backstop plate may be adjustably mounted onto this secondary spring element for variable positioning thereon to adjust the resultant biasing force applied to the cam pin. The secondary spring element and the cam pin are movable axially with the spring leaf for maintaining axial alignment and engagement with the cam wheel, as the fixture pin retracts in the course of a nut installation procedure.

In use, the fixture pin key is slidably seated into the end recess formed in the fastener shank to retain the fastener against rotation as a threaded nut is rotatably advanced onto the threaded shank by the power-driven socket. As the nut is advanced onto the shank, the fixture pin slidably retracts relative to the socket and tool head, against the biasing action of the first spring force. In the event that rotational torque is transmitted through the fastener shank to the fixture pin, wherein this torque exceeds a predetermined threshold defining a torque overload condition, the spring-loaded cam pin retracts radially to permit at least limited rotation of the fixture pin and key through a sufficient increment to protect these components against torque overload damage.

Other features and advantages of the present invention will become more apparent from the following detailed description taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
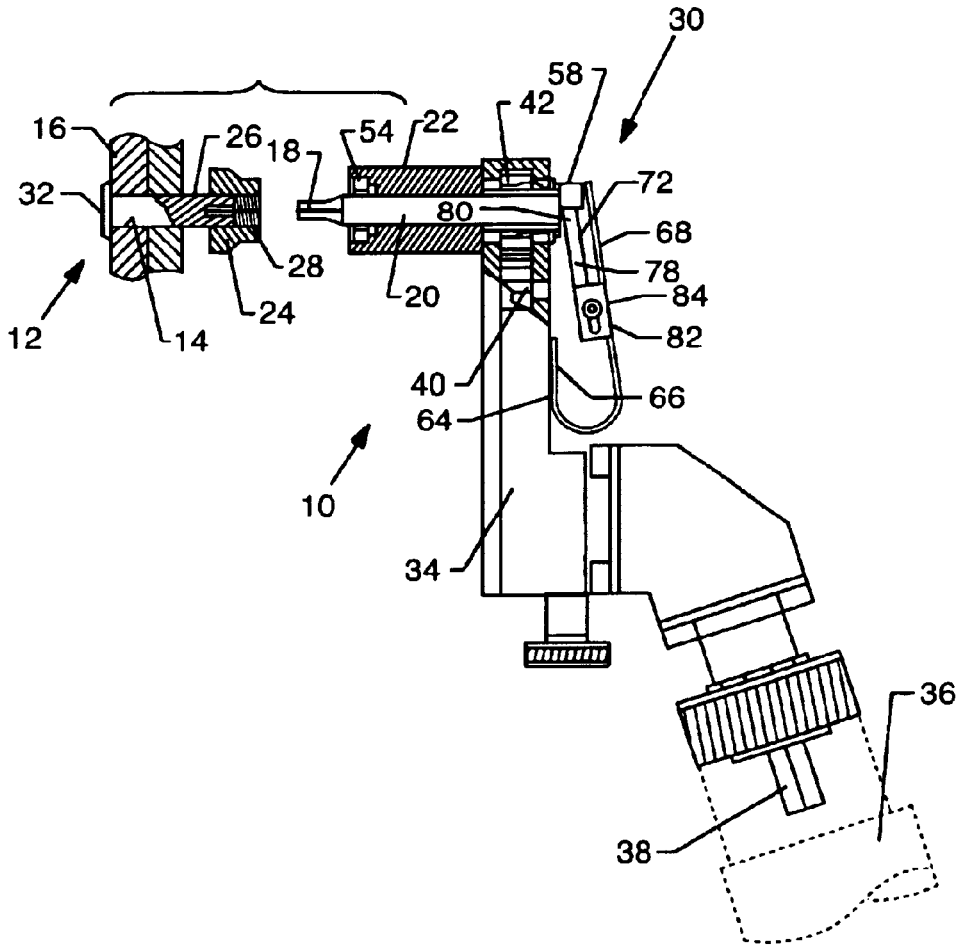
FIG. 1 is an exploded side elevational view, shown partially in vertical section, depicting the improved fastener installation tool of the present invention, for engaging and installing a threaded fastener.

As shown in the exemplary drawings, an improved fastener installation tool referred to generally by the reference numeral 10 is provided for installing a threaded fastener 12 such as a bolt in a position extending through a port or opening 14 formed in a substrate 16. The installation tool 10 includes a relatively small key 18 at the leading or distal end of a fixture pin 20 supported generally coaxially within a power-driven socket 22 for installing a threaded nut 24 onto a threaded shank 26 of the fastener 12. The fixture pin key 18 is sized and shaped, such as a hexagonal cross section, for seated reception into a matingly shaped recess 28 formed in the end of the fastener shank 26, to support the fastener 12 substantially against rotation during power-driven installation of the threaded nut 24. In accordance with the invention, the installation tool 10 includes a simplified spring-loaded clutch assembly 30 for permitting at least limited rotation of the fixture pin 20 and the related key 18 sufficient to prevent component damage due to deformation or breakage in the event of a high torque load applied thereto.

Figure 2:
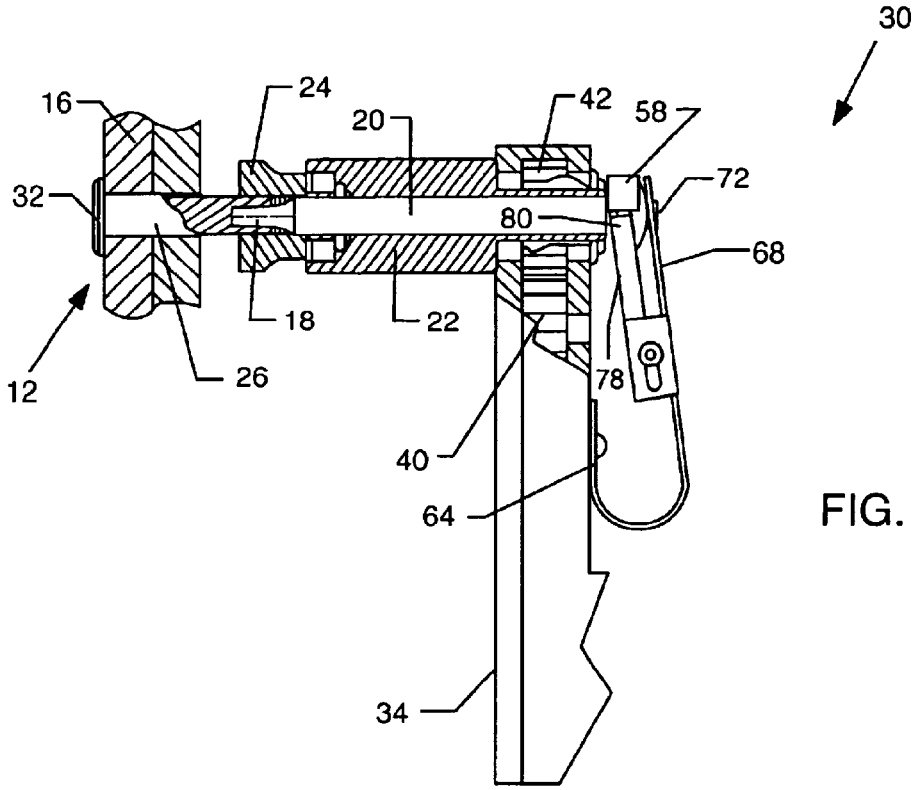
FIG. 2 is a fragmented sectional view similar to a portion of FIG. 1 and illustrating initial engagement of the installation tool with the threaded fastener.
Figure 3:
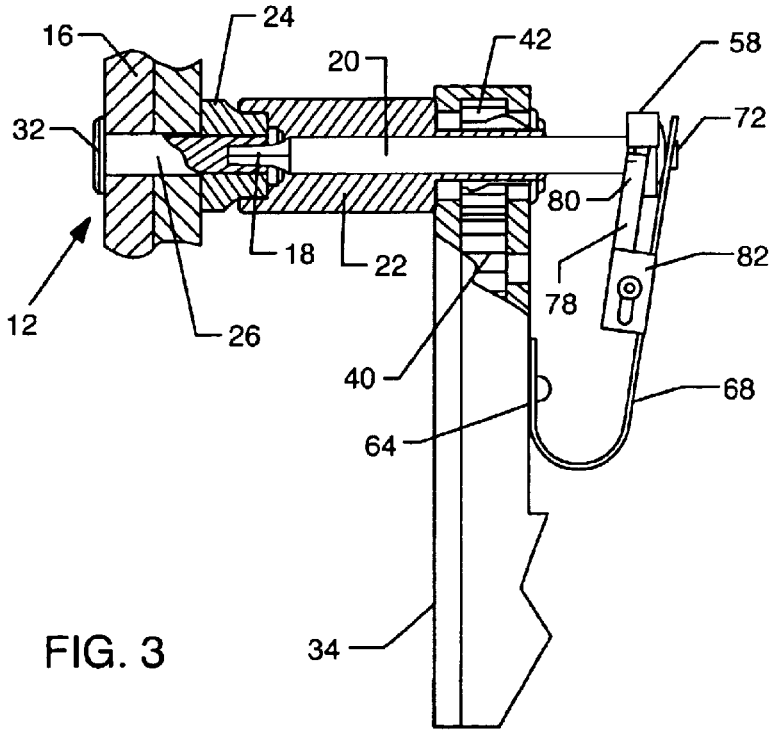
FIG. 3 is a fragmented sectional view similar to FIG. 2, and showing final installation of the threaded fastener.

The threaded fastener 12 represents a specialized fastener of a type used extensively in aerospace and related industries, and the installation tool 10 of the present invention represents an improvement upon power-drive tools for installing such fasteners. More particularly, as shown in FIGS. 1–3, the fastener 12 comprises the elongated bolt shank 26 which includes an externally threaded segment and is joined at one end to a radially enlarged bolt head 32. The threaded shank 26 has a diametric size and an axial length to fit through the substrate opening 14 which is normally preformed therein, wherein the substrate may comprise one or multiple panels formed from a selected material or materials such as metal or composite materials. The leading or tip end of the bolt shank 26 protrudes beyond a front or otherwise accessible surface of the substrate 16 with the threaded segment thereon exposed for thread-on installation of the nut 24. The shallow recess 28 formed in the leading or tip end of the bolt shank 26 has a noncircular cross sectional shape, such as a hexagonal configuration, for mating reception of and engagement by the key 18 at the leading end of the fixture pin 20. In general, the fixture pin 20 and the related key 18 are normally constrained against rotation to correspondingly support the bolt shank 26 against rotation while the power-driven socket 22 is used for rotatably mounting the nut 24 onto the bolt shank. Persons skilled in the art will recognize and appreciate that alternative noncircular cross sectional mating shapes for the shank recess 28 and the fixture pin key 18 may be used.

In some fastener installations, the substrate 16 and/or the presence of sealant material (not shown) for sealing the substrate port 14 provides inadequate friction resistance for supporting the bolt shank 26 against rotation during power-driven nut installation. As a result, there may be brief occasions or intervals during which a substantial portion of the drive torque applied to the nut 24 is transmitted through the bolt shank 26 to the key 18 and the related fixture pin 20. In some cases, this may subject the key 18 and/or the fixture pin 20 to a sufficiently high torque load, or overload, to cause damage to these components such as by bending or breaking. U.S. Pat. No. 5,553,519, which is incorporated by reference herein, discloses a fastener installation tool with a spring-loaded clutch assembly for permitting at least some fixture pin rotation in response to a torque overload condition, thereby protecting the fixture pin 20 and key 18 against torque overload damage. The clutch assembly 30 of the present invention similarly safeguards the fixture pin 20 and key 18 against torque overload damage, by means of an improved and simplified clutch construction which may be produced economically from a relative minimum number of component parts.

Figure 4:
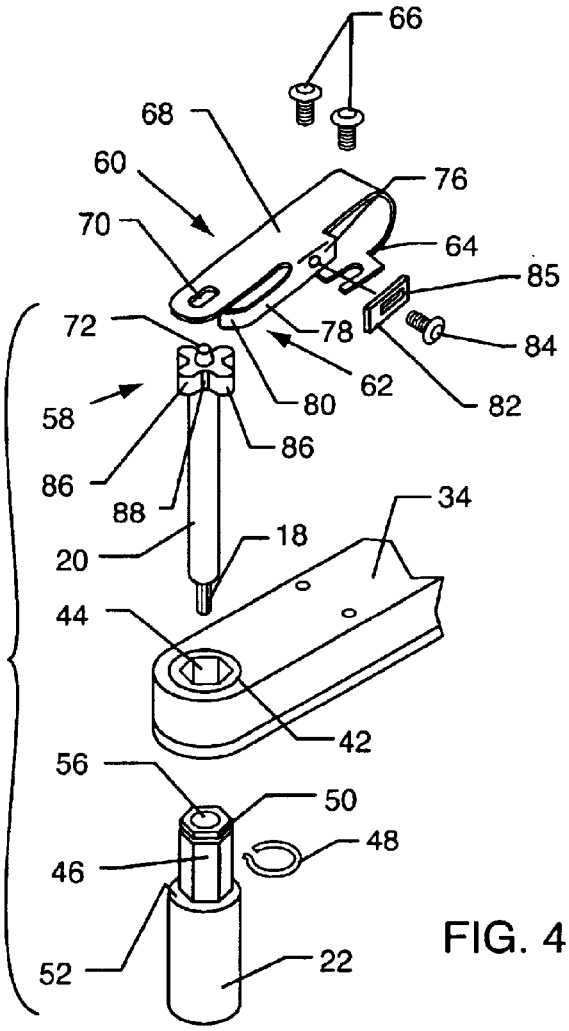
FIG. 4 is an exploded and fragmented perspective view illustrating assembly of components comprising the fastener installation tool.
Figure 5:
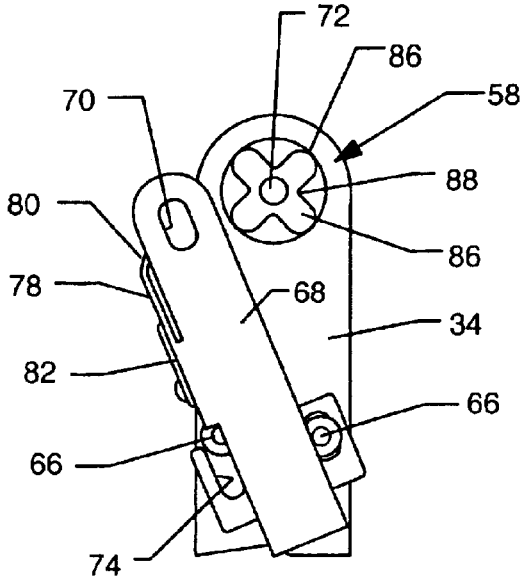
FIG. 5 is a fragmented rear elevation view of a portion of the fastener installation tool, depicting assembly of a dual function spring member onto a tool head.
Figure 6:
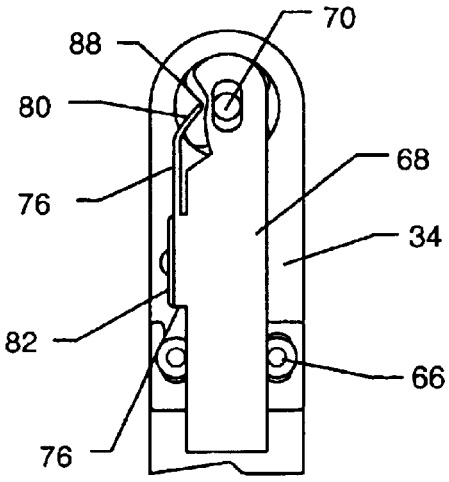
FIG. 6 is a fragmented rear elevation view similar to FIG. 5, and showing a cam pin on the spring element for normally retaining a tool fixture pin against rotation.
Figure 7:
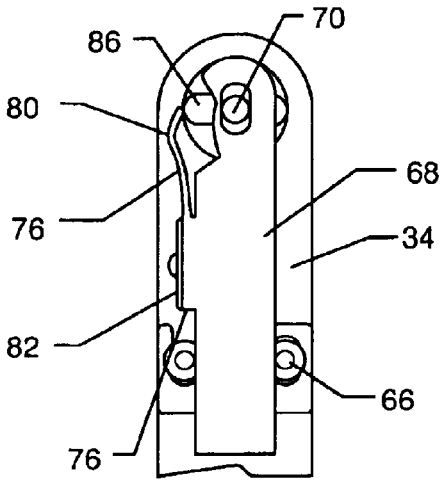
FIG. 7 is a fragmented rear elevation view similar to FIG. 6, and illustrating cam pin retraction to accommodate limited rotation of the fixture pin in a torque overload condition.

As shown generally in FIG. 1, the installation tool 10 comprises a relatively compact and preferably hand-held housing or tool head 34 adapted for mount-on quick-connect coupling to the drive end of a power tool 36, such as a rotary drive pneumatic tool of the type commonly used in manufacturing and maintenance facilities. A drive shaft 38 on the tool head 34 is rotatably driven by the power tool 36, and this rotary drive motion is transmitted through a gear train 40 to a driven gear 42 connected as by a hex hub 44 (shown best in FIG. 4) or the like for power-drive rotation of the socket 22. In this regard, in accordance with one form, the illustrative socket 22 comprises a generally cylindrical body having a rear end segment defined by a hex shaped exterior 46 having a size and shape for mating slide-fit reception into and through the hex hub 44 on the tool head 34. A retainer ring 48 may be snap-fitted into an external groove 50 on the socket 22 for axially capturing and retaining the rear end segment 46 of the socket 22 in driven engagement with the driven gear 42, between the retainer ring 48 and a radially expanded socket shoulder 52. Alternately, it will be understood that other drive connections may be employed, including but not limited to alternative matingly interfitting non-circular cross sectional shapes for the driven gear hub 44 and the driven rear segment 46 of the socket 22.

The forward or leading end of the socket 22 defines a forwardly open nut cavity 54 (FIGS. 1–3) for receiving and supporting the internally threaded nut 24 for power-drive installation onto the fastener shank 26. In one common form, this nut cavity 54 has a hexagonal cross sectional shape for slide-fit reception of a nut 24 having a matingly sized hexagonal configuration, although alternative shapes for the nut cavity 54 and nut 24 may be used.

The fixture pin 20 is supported within the tool head 34, by slide-fit mounting into a central bore 56 (shown best in FIG. 4) of circular cross sectional shape formed in the tool socket 22. In this regard, the fixture pin 20 has a cross sectional size for relatively mating slide-fit reception into and through the socket bore 56, to accommodate relative rotation between the socket 22 and the fixture pin 20. Accordingly, while the fixture pin 20 is normally constrained against rotation as will be described in more detail, the socket 22 is rotatably supported on the fixture pin 20 for power-driven rotation to install the nut 24 onto the bolt shank 26.

As shown in FIGS. 1–7, the rear or trailing end of the fixture pin 20 carries a radially enlarged cam wheel 58 forming a portion of the cam assembly 30, wherein this cam wheel 58 may be connected to or formed integrally with the fixture pin. In a normal position, this cam wheel 58 is disposed in abutting engagement with a rear end of the tool socket 22, adjacent the retaining ring 48. In this normal position, a front or leading end of the fixture pin 20 protrudes a short distance beyond a front or leading end of the socket 22. The key 18 is carried at this leading or front end of the fixture pin 20 whereat it normally protrudes and is exposed for relatively quick and easy seated reception into the matingly shaped recess 28 formed in the leading end of the bolt shank 26.

With the key 18 engaged with the bolt shank 26 (FIG. 2), a nut 24 received at least partially into the socket cavity 54 can be power-drive rotated upon actuation of the tool 38 for thread-on mounting of the nut 24 onto the threaded shank 26 of the fastener 12. Importantly, as this installation proceeds, the socket 22 advances axially toward the substrate 16 until the nut 24 is fully seated and tightened onto the bolt shank 26, as viewed in FIG. 3). Such advancement of the socket 22 is accompanied by relative axial retraction of the fixture pin 20 relative to the socket 22. Importantly, during this installation procedure, the improved clutch assembly 30 performs the dual functions of maintaining the fixture pin 20 with the key thereon in engagement with the fastener recess 28, and constrains the fixture pin 20 and key 18 against rotation while permitting at least some rotation in response to a torque overload condition.

The improved clutch assembly 30 generally comprises, in accordance with the illustrative preferred form of the invention, a dual or multi-function spring member mounted onto a rear end or rear side of the tool head 34, in engagement with the fixture pin 20 and the cam wheel 58 carried thereby. In general, this dual function spring member comprises a pair of primary and secondary spring elements, such as the illustrative springs 60 and 62 (FIG. 4) for respectively applying biasing spring forces for urging the fixture pin 20 axially forwardly within the socket 22, and for normally retaining the fixture pin 20 against rotation within the socket 22. In the most preferred form of the invention as shown, these two springs 60 and 62 comprise cantilever-mounted leaf springs formed as different portions of the dual function spring member which can be otherwise constructed as a one-piece component from a selected spring material such as spring steel or the like.

More particularly, the primary spring element or first spring 60 is shown to include a base end 64 adapted for quick and easy attachment to the rear side of the tool head 34 by means of a pair of screws 66 or the like. From the base end 64, the spring curves rearwardly and then extends upwardly through a smooth turn of about 180° to extend upwardly to define a cantilevered spring leg 68 disposed in rearwardly spaced and cantilevered relation to the rear side of the tool head 34. A vertically elongated slot 70 is formed in this cantilevered leg 68 near an upper distal end thereof for slidably receiving a rearwardly projecting coaxial tab 72 formed on the fixture pin 20, or on the cam wheel 58 carried thereby. As shown best in FIG. 5, the base end 64 of the spring 60 may include one or more elongated slots 74 for receiving the mounting screws 66, thereby accommodating partial loosening of these screws 66 and lateral disengagement of the spring leg 68 from the fixture pin 20 for facilitated changing of the fixture pin, for example, when a different sized key 18 is required.

Figure 8:
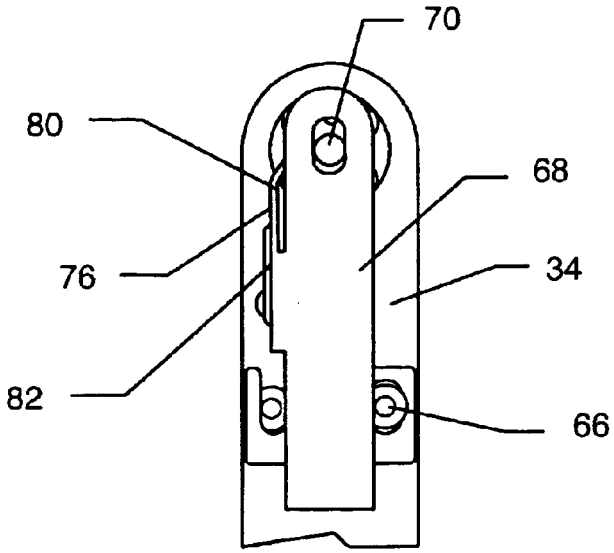
FIG. 8 is a fragmented rear elevation view similar to FIG. 5, and showing variable setting of a spring force applied to the cam pin.

The secondary spring element or second spring 62 is shown is the form of a lateral segment formed integrally with the cantilevered spring leg 68 of the first spring 60. More particularly, a base end 76 of the second spring 62 is bent or folded forwardly relative to the spring leg 68 at one side thereof. From this base end, the second spring 62 defines an elongated spring leg 78 which is cantilevered relative to the base end 76, and terminates in a distal end forming a generally radially inwardly turned cam pin 80 positioned for engaging the cam wheel 58. If desired, a relatively stiff overlay bracket or bracket plate 82 may be attached to the cantilevered spring leg 78 by means of a screw 84 or the like, wherein the screw 84 is passed through an elongated slot 85 in the bracket 82 to permit selective variable positioning of the bracket along the length of the spring leg 78 to variably select and adjust the spring force applied to the cam pin 80, for purposes to be described in more detail. That is, positioning of the overlay bracket 82 on or closer to the base end 76 of the spring leg 78 reduces the magnitude of the applied spring force (FIGS. 6–7), whereas shifting the bracket to a position closer to the cam pin 80 (FIG. 8) stiffens the spring leg 78 and thereby increases the applied spring force.

The cam wheel 58 at the rear end of the fixture pin 20 defines a plurality of radially outwardly extending lobes 86 separated by intervening recessed cam seats or detents 88. The spring-loaded cam pin 80 is normally seated within one of these detents 88 (FIG. 6) with the applied spring force normally retaining the cam wheel 58 and the related fixture pin 20 and key 18 against rotation. However, in response to a relatively high torque load applied to the fixture pin 20, in excess of a threshold defined by the adjustable applied spring force, the cam pin 80 will retract (FIG. 7) to permit indexed rotation sufficient to safeguard the components against torque overload damage.

In use, as the power-driven socket 22 installs a threaded nut 24 onto the threaded shank 26 of the fastener 12, the fixture pin 20 is retracted progressively in an axial rearward direction relative to the socket, against the first spring force applied by the cantilevered leg 68 of the first spring 60. As the fixture pin 20 translates axially rearwardly, the spring leg 68 displaces rearwardly from the tool head 34, as shown best in FIG. 3, with the slot 70 in the spring leg 68 retaining the tab 72 therein during such rearward movement. As a result, when the nut installation process is completed, and the socket 22 is retracted from the nut 24, the spring leg 68 returns the fixture pin 20 and the key 18 thereon to the normal forward position as viewed in FIGS. 1–2.

As the fixture pin 20 is rearwardly displaced during power-drive nut installation, the cantilevered spring leg 78 of the second spring 62 is also translated rearwardly in a manner maintaining the cam pin 80 engaged with the cam wheel 58. With this construction, fixture pin rotation is springably resisted at all times, whereby the components are safeguarded against torque overload damage at all times. That is, in the event of a torque overload condition at any time during power-driven nut installation, the cam pin 80 is in spring-loaded engagement with the cam wheel 58 to permit limited component rotation sufficient to protect against component damage at any time. In a typical torque over load condition, cam wheel rotation through two or three detents, e.g., less that one revolution, is normally sufficient to prevent damage to the fixture pin 20 and the related key 18. When the nut installation process is completed, the cam pin 80 remains engaged with the cam wheel 58 upon spring-loaded forward movement of the fixture pin 20.

Figure 9:
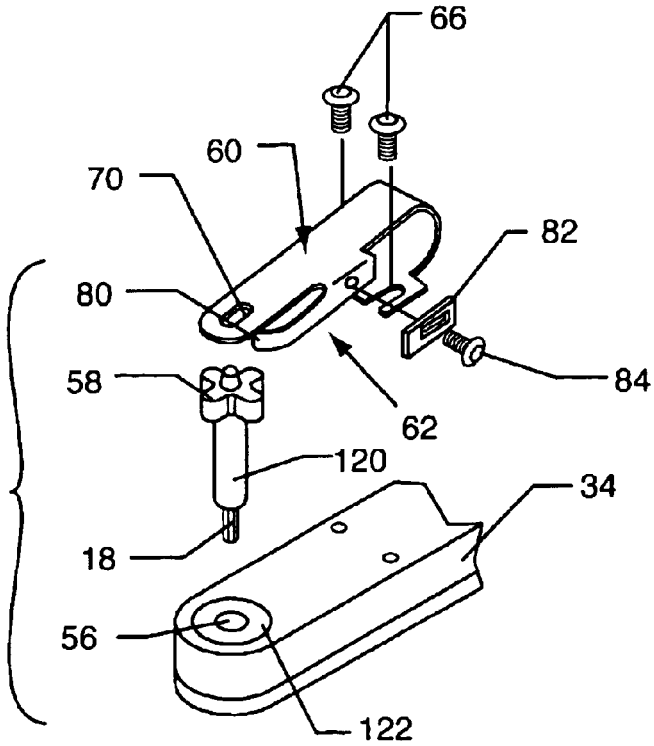
FIG. 9 is an exploded and fragmented perspective view similar to FIG. 4 but depicting an alternative preferred form of the invention.

FIG. 9 depicts one alternative preferred form of the invention, wherein components identical to those shown and described in FIGS. 1–8 are identified by the same reference numerals, and modified components which otherwise correspond in structure and function to those previously shown and described in FIGS. 1–8 are identified by common reference numerals increased by 100. As shown, a modified socket 122 is flush-mounted within the tool head 34, as opposed to the socket mount and related tool head configuration shown in FIGS. 1–8. In this alternative embodiment, a comparatively shorter fixture pin 120 is slidably received through a central bore 56 formed in the socket 122. The fixture pin 120 includes a distal end defining a key 18 of hexagonal or other suitable noncircular cross section for mating slide-fit reception into the fastener shank recess 28 (not shown in FIG. 9), and a proximal or rear end carrying a lobed cam wheel 58. A dual function spring member constructed as previously shown and described includes a first leaf spring 60 for biasing the fixture pin 120 in a forward direction, and a second spring 62 for urging a cam pin 80 into seated engagement with the cam wheel 58. In use, the dual function spring member operates as previously shown and described to accommodate fixture pin retraction as the socket 122 drives a nut (not shown) onto the fastener, while concurrently permitting limited fixture pin rotation during a torque overload condition to prevent fixture pin deformation damage or breakage.

The improved clutch assembly 30 thus provides a simple and economically manufactured mechanism using the dual function spring member for axially biasing and rotationally constraining the fixture pin 20. This single component may be mounted onto the tool head 34 quickly and easily, and appropriately adjusted to accommodate, for example, rapid interchange of tool components such as interchangeable fixture pins or tool sockets of different sizes.

A variety of further modifications and improvements in and to the improved fastener installation tool of the present invention will be apparent to those persons skilled in the art. Accordingly, no limitation on the invention is intended by way of the foregoing description and accompanying drawings, except as set forth in the appended claims.

What is claimed is:

1. A fastener installation tool, comprising:

a tool head;

a socket mounted on said tool head for receiving and supporting a threaded nut;

drive means for rotatably driving said socket to install the nut onto a threaded fastener;

a fixture pin mounted on said tool head generally coaxially within said socket, said fixture pin having a tip end for engaging and retaining a threaded fastener to substantially prevent fastener rotation during thread-on installation of a nut;

said fixture pin being axially movable relative to said socket, and said socket being rotatable relative to said fixture pin; and a clutch assembly for rotatably supporting said fixture pin within said socket to permit fixture pin rotation in response to a torque load applied thereto in excess of a predetermined limit, whereby said clutch assembly safeguards said fixture pin against breakage in response to a torque load applied thereto;

said clutch assembly including a cam wheel carried by said fixture pin and defining a plurality of generally radially outwardly open cam seats;

said clutch assembly further including a multi-function spring member having a primary spring element applying an axially directed first spring force urging said fixture pin in a forward direction toward the fastener, and a secondary spring element applying a radially directed second spring force urging a cam pin carried thereby into normal seated engagement with one of said radially outwardly open cam seats defined by said cam wheel.

2. The fastener installation tool of claim 1 wherein said fixture pin in removably slide-fit mounted within a bore formed in said socket.

3. The fastener installation tool of claim 1 wherein said multi-function spring element comprises a unitary component.

4. The fastener installation tool of claim 1 further including means for selectively adjusting said second spring force.

5. The fastener installation tool of claim 1 wherein said primary spring element comprises a leaf spring engaging a rear end of said fixture pin, and further wherein said secondary spring element comprises a cantilevered spring leg carried by said primary spring element, said cantilevered spring leg having a distal end defining said cam pin.

6. The fastener installation tool of claim 5 wherein said leaf spring has a base end connected to said tool head, and a cantilevered spring leg disposed in rearwardly spaced and cantilevered relation to a rear side of said tool head, said spring leg including a distal end thereof for springably engaging a rear end of said fixture pin.

7. The fastener installation tool of claim 6 wherein said distal end of said spring leg has an elongated slot formed therein for slidably receiving a rearwardly projecting tab carried by said fixture pin.

8. The fastener installation tool of claim 5 further including means for selectively adjusting said second spring force.

9. The fastener installation tool of claim 5 further including a relatively stiff bracket plate adjustably mounted along the length of said cantilevered spring leg for selectively adjusting said second spring force.

10. The fastener installation tool of claim 9 wherein said bracket plate has an elongated slot formed therein, and further including a fastener passed through said slot for adjustably mounting said bracket plate along the length of said cantilevered spring leg.

11. The fastener installation tool of claim 1 wherein said tip end of said fixture pin has a noncircular cross sectional shape.

12. The fastener installation tool of claim 1 wherein said primary spring element comprises a first cantilever spring mounted on said tool head, and wherein said secondary spring element comprises a second cantilever spring carried by said first cantilever spring.

13. The fastener installation tool of claim 12 wherein said first and second cantilever springs are formed with a unitary construction.

14. The fastener installation tool of claim 1 wherein said primary spring element a slotted base end, and further including a fastener passed through said slotted base end for mounting said primary spring element onto said tool head, said slotted base end permitting lateral displacement of said primary spring element without detachment from said tool head for facilitated access to a rear end of said fixture pin.

15. In a fastener installation tool having a socket for receiving and supporting a threaded nut, drive means for rotatably driving the socket for installing the nut onto a threaded fastener, a fixture pin disposed generally coaxially within and axially movable with the socket for engaging and supporting the threaded fastener against rotation during drive installation of the nut onto the fastener, and a clutch assembly rotatably supporting the fixture pin within the socket to permit fixture pin rotation in response to a torque load applied to the fixture pin in excess of a predetermined limit, whereby the clutch assembly safeguards the fixture pin against breakage in response to a torque load applied thereto, the improvement comprising:

a cam wheel carried by said fixture pin and defining a plurality of generally radially outwardly open cam seats; and said clutch assembly including a multi-function spring member having a primary spring element applying an axially directed first spring force urging said fixture pin in a forward direction toward the fastener, and a secondary spring element applying a radially directed second spring force urging a cam pin carried thereby into normal seated engagement with one of said radially outwardly open cam seats defined by said cam wheel.

16. The fastener installation tool of claim 15 further including means for selectively adjusting said second spring force.

17. The fastener installation tool of claim 15 wherein said primary spring element comprises a leaf spring engaging a rear end of said fixture pin, and further wherein said secondary spring element comprises a cantilevered spring leg carried by said primary spring element, said cantilevered spring leg having a distal end defining said cam pin.

18. A fastener installation tool, comprising:

a tool head;

a socket mounted on said tool head for receiving and supporting a threaded nut;

drive means for rotatably driving said socket to install the nut onto a threaded fastener;

a fixture pin mounted on said tool head generally coaxially within said socket, said fixture pin having a tip end for engaging and retaining a threaded fastener to substantially prevent fastener rotation during thread-on installation of a nut;

said fixture pin being axially movable relative to said socket, and said socket being rotatable relative to said fixture pin; and a clutch assembly for rotatably supporting said fixture pin within said socket to permit fixture pin rotation in response to a torque load applied thereto in excess of a predetermined limit, whereby said clutch assembly safeguards said fixture pin against breakage in response to a torque load applied thereto;

said clutch assembly including a cam wheel carried by said fixture pin and defining a plurality of generally radially outwardly open cam seats;

said clutch assembly further including a multi-function spring member having a leaf spring engaging a rear end of said fixture pin for applying an axially directed first spring force urging said fixture pin in a forward direction toward the fastener, and a cantilever spring carried by said leaf spring and including a cam pin at a distal end thereof, said cantilever spring applying a radially directed second spring force urging a cam pin carried thereby into normal seated engagement with one of said radially outwardly open cam seats defined by said cam wheel.

19. The fastener installation tool of claim 18 wherein said multi-function spring element comprises a unitary component.

20. The fastener installation tool of claim 18 further including a relatively stiff bracket plate adjustably mounted along the length of said cantilevered spring leg for selectively adjusting said second spring force.

* * * * *

UNITED STATES PATENT AND TRADEMARK OFFICE

CERTIFICATE OF CORRECTION

PATENT NO. : 6,959,625 B2
DATED : November 1, 2005
INVENTOR(S) : Jack E. Pettit, Jr.

It is certified that error appears in the above-identified patent and that said Letters Patent is hereby corrected as shown below:

Title page,
Item [76], Inventor, Post Office box number should be -- 67 --.

Signed and Sealed this

Thirtieth Day of May, 2006

JON W. DUDAS
*Director of the United States Patent and Trademark Office*